US006654583B2

(12) United States Patent
Suzuki et al.

(10) Patent No.: US 6,654,583 B2
(45) Date of Patent: Nov. 25, 2003

(54) DEVELOPING APPARATUS

(75) Inventors: Tatsuya Suzuki, Shizuoka (JP); Kouji Hashimoto, Shizuoka (JP); Kojiro Yasui, Shizuoka (JP); Susumu Nittani, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/183,462

(22) Filed: Jun. 28, 2002

(65) Prior Publication Data

US 2003/0012588 A1 Jan. 16, 2003

(30) Foreign Application Priority Data

Jul. 4, 2001 (JP) ..... 2001-203078
Jun. 17, 2002 (JP) ..... 2002-175816

(51) Int. Cl.[7] ..... G03G 15/08
(52) U.S. Cl. ..... 399/281; 399/111; 399/119
(58) Field of Search ..... 399/281, 285, 399/279, 272, 111, 234, 235, 119, 113

(56) References Cited

U.S. PATENT DOCUMENTS 5,642,187 A * 6/1997 Nomura et al. ..... 399/111
6,173,145 B1 * 1/2001 Chadani et al. ..... 399/279
6,229,979 B1 * 5/2001 Ishii et al. ..... 399/281
2001/0024581 A1 * 9/2001 Miyabe et al. ..... 399/111

FOREIGN PATENT DOCUMENTS

JP 03126056 A * 5/1991 ..... G03G/15/08

* cited by examiner

*Primary Examiner*—Hoang Ngo
(74) *Attorney, Agent, or Firm*—Fitzpatrick, Cella, Harper & Scinto

(57) ABSTRACT

A developing apparatus includes a developer carrying member for carrying a developer thereon. An electrostatic image is formed on an image bearing member with the developer. A rotatable developer electrifying member contacts the developer carrying member and electrifies the developer carried on the developer carrying member. A holding member supports the developer electrifying member and the developer carrying member. A bearing assembled to the holding member receives a shaft of the developer electrifying member. The developer electrifying member is held by the holding member through the bearing member.

19 Claims, 17 Drawing Sheets

DEVELOPING APPARATUS

BACKGROUND OF THE INVENTION

1. Field of the Invention

This invention relates to a developing apparatus for developing an electrostatic image on an image bearing member with a developer.

2. Description of Related Art

The prior art and problems peculiar thereto will hereinafter be described with reference to FIG. 9 of the accompanying drawings. FIG. 9 is an illustration of portions around a developing roller which is the developer carrying member of a developing apparatus according to the prior art.

In image forming apparatuses using the electrophotographic image forming process, use has heretofore been made of the process cartridge system in which a photosensitive drum and process means for acting on the photosensitive drum are integrally made into a cartridge which is made detachably attachable to the main body of an image forming apparatus. According to this process cartridge system, the maintenance of the apparatus can be done by a user himself without resort to a serviceman and therefore, the operability of the apparatus could be markedly improved. So, this process cartridge system is widely used in image forming apparatuses.

Recently there have been produced many such process cartridges available for use in color image forming apparatuses. A higher quality of image than before will be expected of image forming apparatuses in the future including such color image forming apparatuses.

On the other hand, in a developing apparatus using a non-magnetic toner, the electrification charge amount of the developer (toner) on a developing roller has been liable to become unstable depending on the environment (such as temperature and humidity) in which it is placed, and it has sometimes affected the quality of image.

In order to mitigate such influence of the environment, there has heretofore been adopted means such as regulating a developing bias value in conformity with the environment. Also, recently, in order to enable the electrifying charge amount of the toner on the developing roller to be obtained stably without being affected by such environmental factors, use has come to be made of a toner electrifying roller or the like which is a developer electrifying member.

The toner electrifying roller is in contact with the developing roller and uniformly imparts charges to the toner on the developing roller while being driven to rotate thereby. Also, the toner electrifying roller has its outer peripheral surface pressurized by a torsion coil spring or the like, whereby there has been adopted a construction in which it contacts with the developing roller and is driven to rotate thereby.

As shown in FIG. 9, however, there has been adopted a construction in which a conventional toner electrifying roller 102 has its outer peripheral surface pressurized by a torsion coil spring 103 or the like, whereby it is pressed against a developing roller 101 and is driven to rotate thereby and therefore, when the balance between the resistance by the pressure force of the spring 103 and the frictional force with the developing roller 101 through a toner layer is destroyed, bad rotation or the like may occur and it may cause the aggravation of the quality of image.

As an example of using a toner electrifying roller is disclosed in U.S. Pat. No. 6,411,791.

SUMMARY OF THE INVENTION

It is an object of the present invention to provide a developing apparatus in which the pressure of a developer electrifying member to a developer carrying member is stabilized.

It is another object of the present invention to provide a developing apparatus in which charges are uniformly imparted to a developer carried on a developer carrying member by a developer electrifying member.

It is still another object of the present invention to provide a developing apparatus in which a developer electrifying member can be made stably rotatable.

It is yet still another object of the present invention to provide a developing apparatus in which a developer electrifying member can be stably held.

Further objects and features of the present invention will become more fully apparent from the following detailed description when re and with reference to the accompanying drawings.

DETAILED DESCRIPTION OF THE PREFERRED EMBODIMENTS

Figure 1:
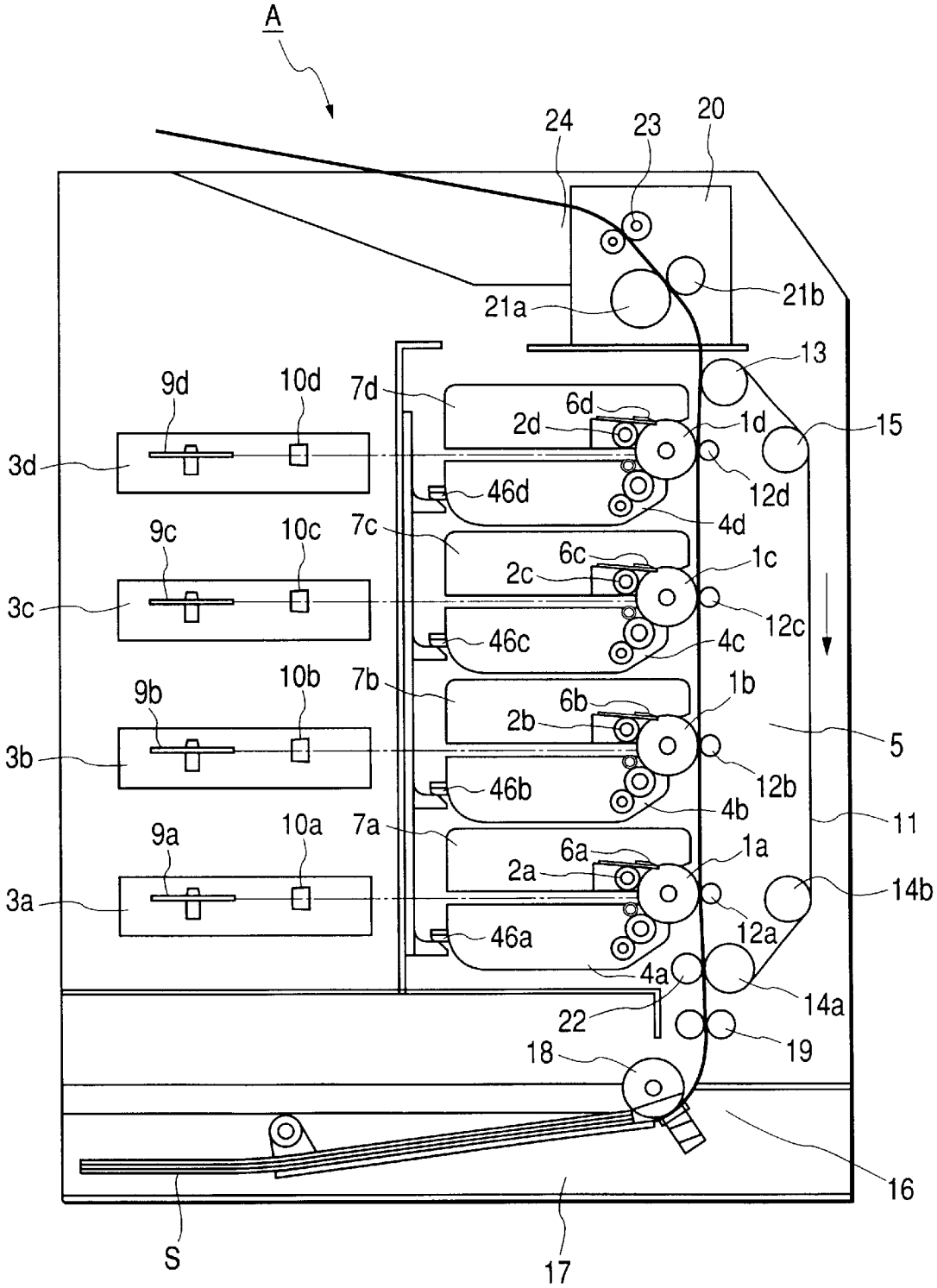
FIG. 1 is a vertical cross-sectional view showing the general construction of an image forming apparatus.
Figure 2:
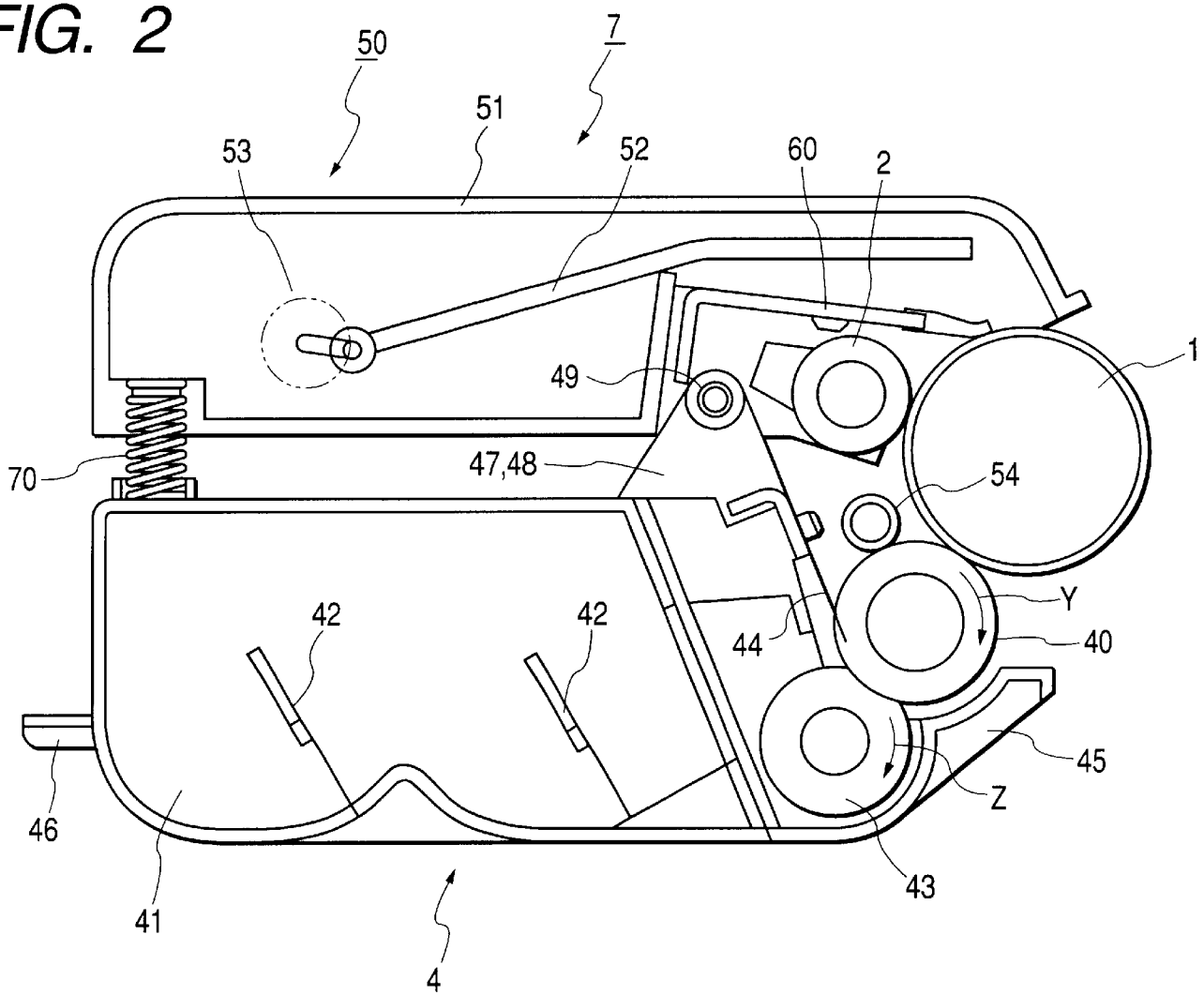
FIG. 2 is a cross-sectional view of a process cartridge.
Figure 3:
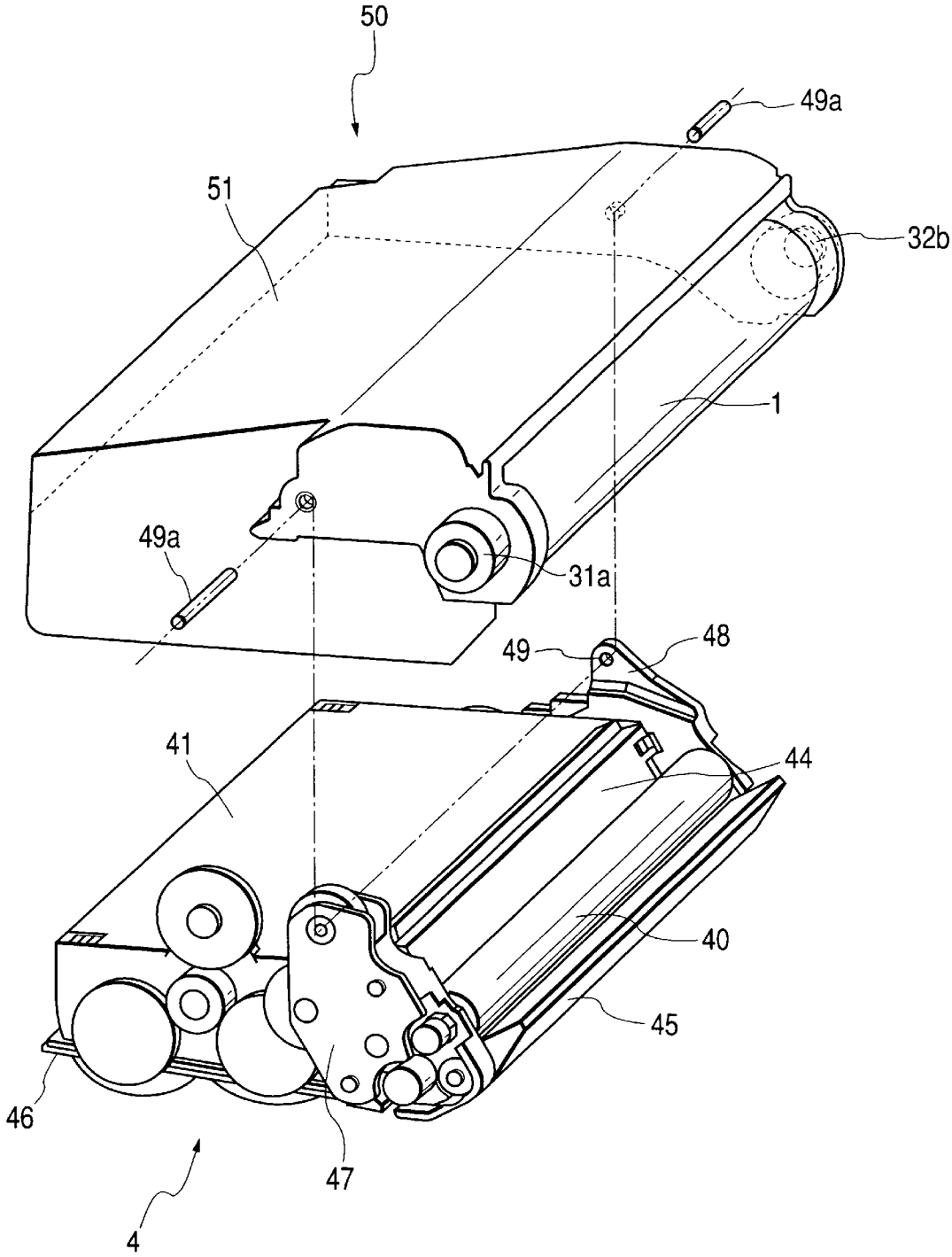
FIG. 3 is a perspective view of a process cartridge.
Figure 4:
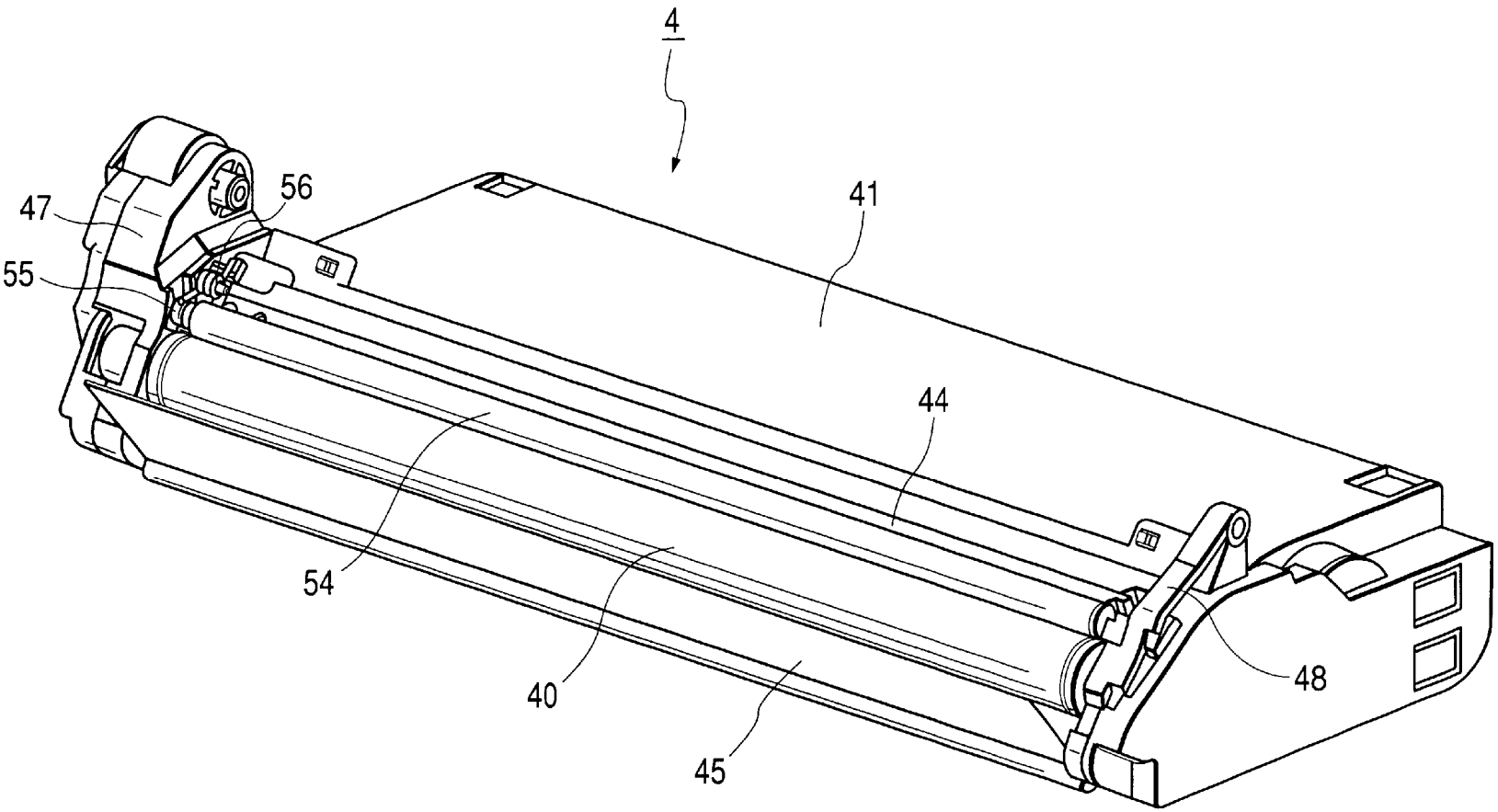
FIG. 4 is a perspective view of a developing apparatus.
Figure 5:
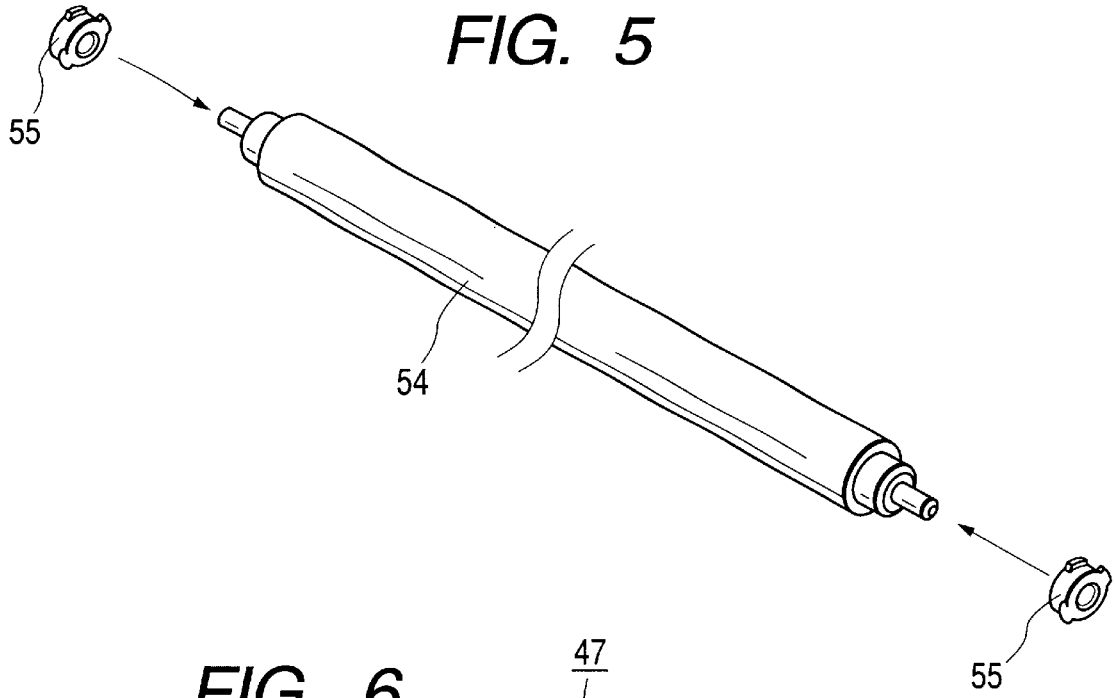
FIG. 5 is a perspective view of a toner electrifying roller.
Figure 6:
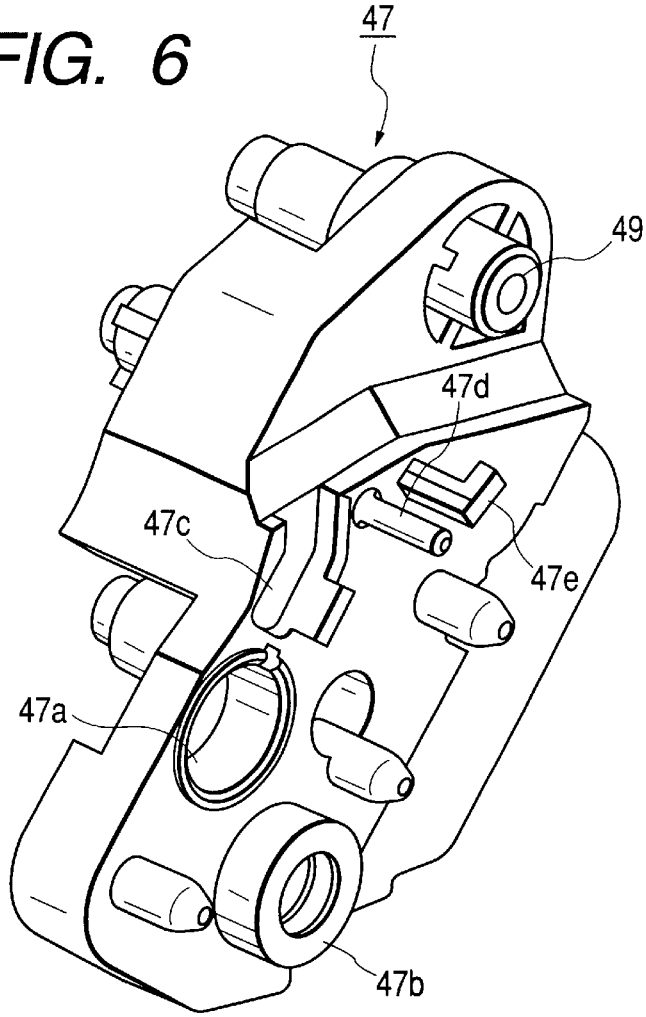
FIG. 6 is an illustration of a holding member.
Figure 7:
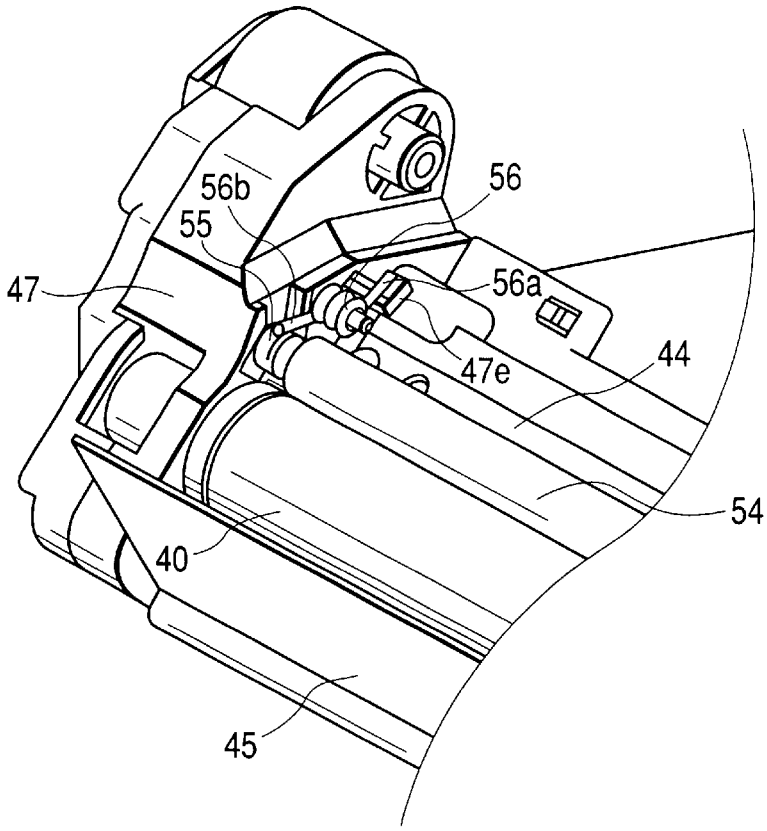
FIG. 7 illustrates the disposition of a toner electrifying roller pressurizing spring.
Figure 8:
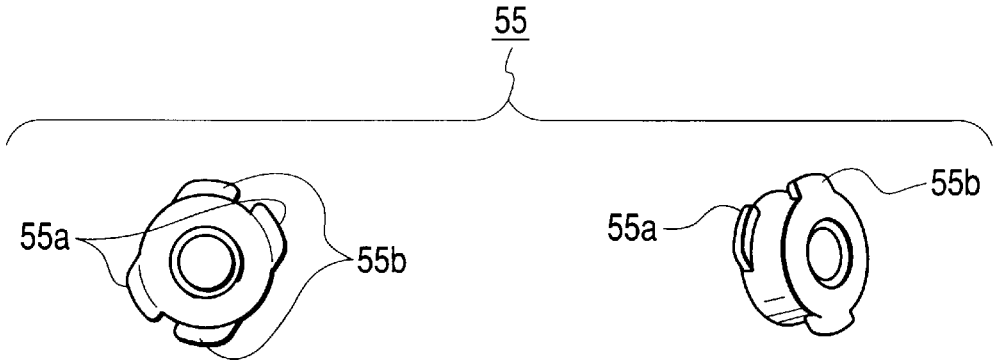
FIG. 8 is an illustration of a bearing member.
Figure 9:
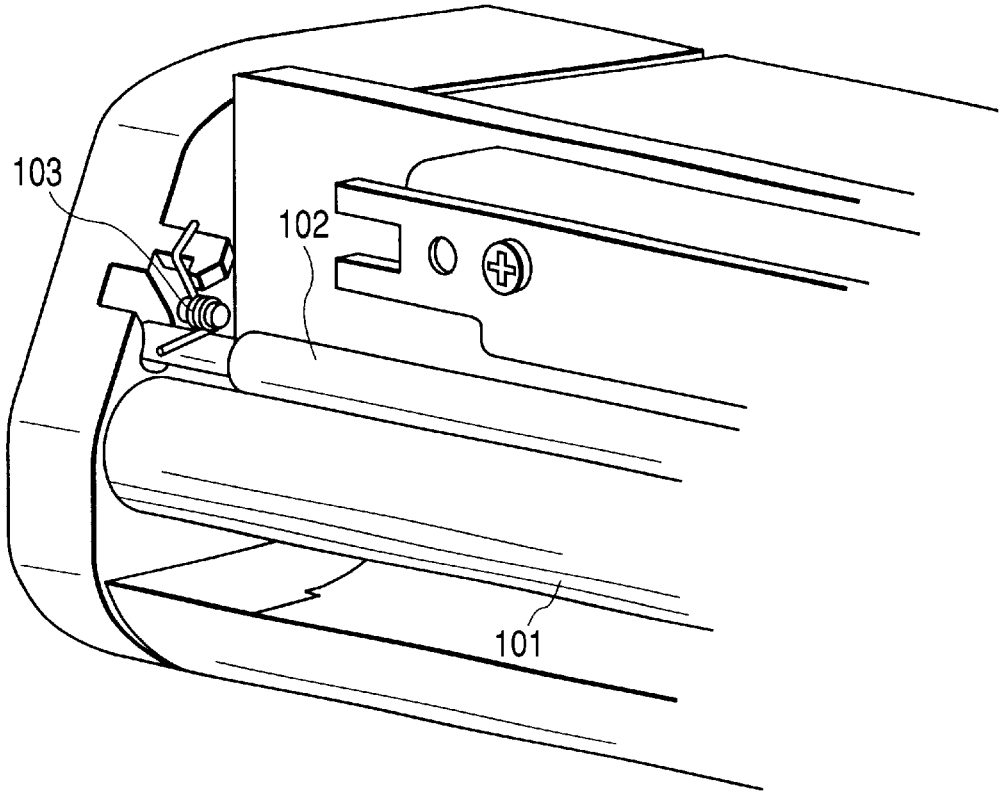
FIG. 9 is an illustration of portions around a conventional developing roller.

Some embodiments of an image forming apparatus according to the present invention will hereinafter be described in detail with reference to the drawings. FIG. 1 is a vertical cross-sectional view showing the general construction of the image forming apparatus, FIG. 2 is a cross-sectional view of a process cartridge, FIG. 3 is a perspective view of the process cartridge, FIG. 4 is a perspective view of a developing apparatus, FIG. 5 is a perspective view of a toner electrifying roller, FIG. 6 is an illustration of a holding member (developing holder), FIG. 7 illustrates the disposition of a toner electrifying roller pressurizing spring, and FIG. 8 is an illustration of a bearing member.

General Construction of the Image Forming Apparatus

The general construction of the image forming apparatus will first be described schematically with reference to FIG. 1. The image forming apparatus a shown in FIG. 1 is provided with four photosensitive drums 1 (1*a*, 1*b*, 1*c* and 1*d*) as image bearing members vertically juxtaposed. The photosensitive drums 1 are counter-clockwisely rotatively driven by driving means (not shown). Around the photosensitive drums 1, there are disposed electrifying devices 2 (2*a*, 2*b*, 2*c* and 2*d*) as electrifying means for uniformly electrifying the surfaces of the photosensitive drums 1, scanner units 3 (3*a*, 3*b*, 3*c* and 3*d*) as exposing means for applying laser beams on the basis of image information and forming electrostatic latent images on the photosensitive drums 1, developing apparatuses 4 (4*a*, 4*b*, 4*c* and 4*d*) as developing means for causing toners as developers to adhere to the electrostatic latent images and developing the latent images as toner images, electrostatic transferring apparatuses 5 for transferring the toner images on the photosensitive drums 1 to a transferring material S, cleaning apparatuses 6 (6*a*, 6*b*, 6*c* and 6*d*) as cleaning means for removing any untransferred toners residual on the surfaces of the photosensitive drums 1 after the transfer, etc.

The photosensitive drums 1, the electrifying devices 2, the developing apparatuses 4 and the cleaning apparatuses 6 are integrally made into cartridges to thereby form process cartridges 7 (7*a*, 7*b*, 7*c* and 7*d*). Here, the electrifying means, the exposing means, the developing means and the cleaning means are generically named process means acting on the photosensitive drums 1.

Description will hereinafter be made in succession from the photosensitive drums 1.

Each photosensitive drum 1 is comprised, for example, an aluminum cylinder having a diameter of 30 mm and an organic photoconductive layer (OPC photoconductor) applied to the outer peripheral surface thereof. The photosensitive drum 1 has its opposite end portions rotatably supported by support members, and a driving force from a driving motor (not shown) is transmitted to one of the end portions, whereby the photosensitive drum is counter-clockwisely rotatively driven.

As the electrifying device 2, use can be made of one of the contact electrifying type. An electrifying member is an electrically conductive roller formed into a roller shape, and this roller is brought into contact with the surface of the photosensitive drum 1, and an electrifying bias voltage is applied to this roller to thereby uniformly electrify the surface of the photosensitive drum 1.

Figure 11:
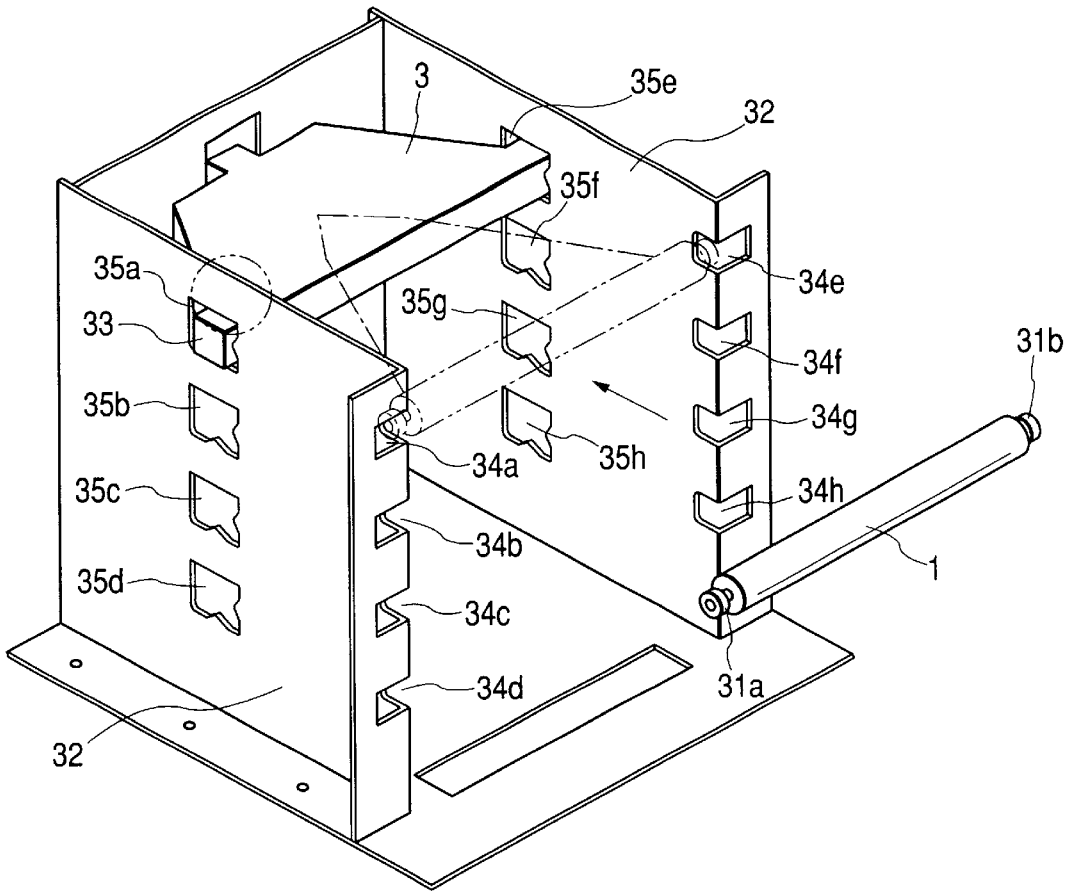
FIG. 11 illustrates a method of mounting the process cartridge on the image forming apparatus.
Figure 12:
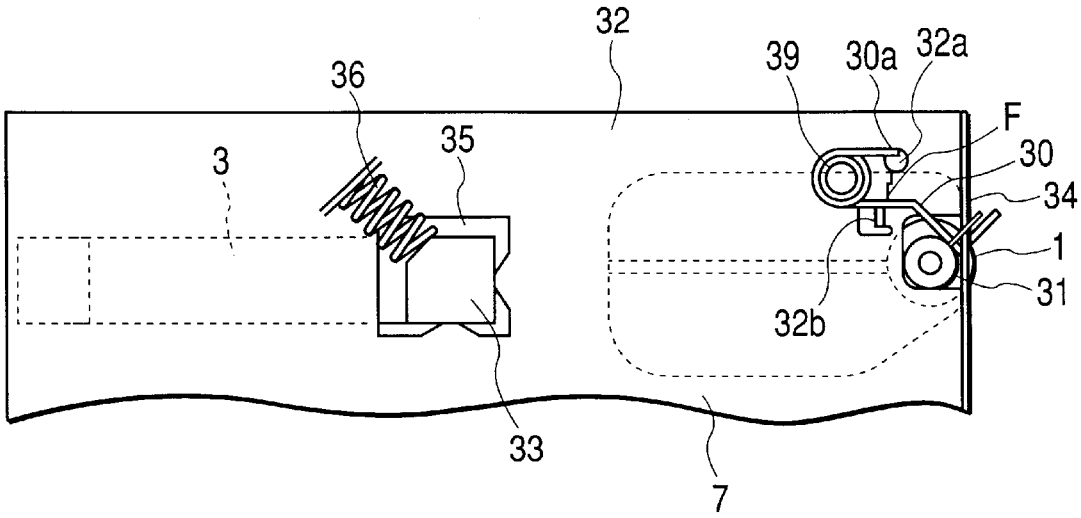
FIG. 12 illustrates a method of positioning the process cartridge in the image forming apparatus.

The scanner units 3 are disposed substantially in the horizontal direction of the photosensitive drum 1, and image light corresponding to an image signal is applied to polygon mirrors 9 (9*a*, 9*b*, 9*c* and 9*d*) rotated at a high spaced by scanner motors (not shown), by a laser diode (not shown). Design is made such that the image light reflected by the polygon mirrors 9 selectively exposes thereto the surface of the electrified photosensitive drum 1 through imaging lenses 10 (10*a*, 10*b*, 10*c* and 10*d*) to thereby form an electrostatic latent image. Also, the scanner unit 3, as shown in FIG. 11, is formed longer in the lengthwise direction thereof than the pitch between left and right side plates, and is mounted so that the projected portions 33 of the scanner unit 3 may jump outwardly from openings 35*a* to 35*h* in the left and right side plates 32. At that time, the scanner unit, as shown in FIG. 12, is pressed downwardly by about 45° as indicated by an arrow F with a force of about 9.8N by a compression spring 36. Thereby the scanner unit is reliably urged against and positioned on bumping portions.

The developing apparatuses 4 are comprised of toner contained 41 (41*a*, 41*b*, 41*c* and 41*d*) as developing containers as shown in FIG. 2 containing therein toners comprising yellow, magenta, cyan and black non-magnetic one-component developers, and a developing frame 45, and the toner in each toner container 41 is fed onto a toner supplying roller 43 by a toner carrying mechanism 42. Thereafter, the toner is applied to the outer periphery of a developing roller 40 clockwisely rotated as viewed in FIG. 2 by the toner supplying roller 43 clockwisely rotated as viewed in FIG. 2 and a developing blade 44 abutting against the outer periphery of the developing roller 40 as a developer carrying member, and charges of the negative polarity are imparted to the toner. A developing bias is then applied to the developing roller 40 opposed to the photosensitive drum 1 on which the electrostatic latent image has been formed, whereby toner development is effected on the photosensitive drum 1 in conformity with the electrostatic latent image thereon.

A circularly moved electrostatic transferring belt 11 is disposed so as to be opposed to and contact with all photosensitive drums 1*a*, 1*b*, 1*c* and 1*d*. The electrostatic transferring belt 11 is comprised of a film-like member having a volume resistivity of $10^{11}$ to $10^{14}$ Ω·cm and having a thickness of about 150 μm. The electrostatic transferring belt 11 is vertically supported on four shafts by rollers, and is circularly moved to electrostatically adsorb the transferring material S to the left outer peripheral surface as viewed in FIG. 1 and bring the transferring material S into contact with the photosensitive drums 1. Thereby, the transferring material S is conveyed to a transferring position by the electrostatic transferring belt 11, and the toner images on the photosensitive drums 1 are transferred to the transferring material S.

Transferring rollers 12 (12*a*, 12*b*, 12*c* and 12*d*) are juxtaposed at locations in contact with the inner side of the electrostatic transferring belt 11 and opposed to the four photosensitive drums 1*a*, 1*b*, 1*c* and 1*d*. Charges of the positive polarity are imparted from these transferring rollers 12 to the transferring materials S through the electrostatic transferring belt 11, and by an electric field by these charges, the toner images of the negative polarity on the photosensitive drums 1 are transferred to the transferring material S being in contact with the photosensitive drums 1.

The electrostatic transferring belt 11 is a belt having a circumferential length of about 700 mm and a thickness of 150 μm, and is passed over four rollers, i.e., a driving roller 13, driven rollers 14*a*, 14*b* and a tension roller 15 and is rotated in the direction of arrow. Thereby, the electrostatic transferring belt 11 is circularly moved and the toner images are transferred while the transferring material S is conveyed from the driven roller 14*a* side to the driving roller 13 side.

A feeding portion 16 is for feeding the transferring material S to the image forming portion, and a plurality of transferring materials S are contained in a feed cassette 17.

During image formation, a feed roller 18 (half moon roller) and a pair of registration rollers 19 are rotatively driven in conformity with the image forming operation, and the transferring materials S in the feed cassette 17 are separated and fed one by one and the leading edge of the transferring material S strikes against the pair of registration rollers 19 and the transferring material S is once stopped thereby, and forms a loop, whereafter it is fed to the electrostatic transferring belt 11 by the pair of registration rollers 19 with the rotation of the electrostatic transferring belt 11 synchronized with the image writing start position.

A fixing portion 20 is provided for fixing the toner images of the plural colors transferred to the transferring material S, and comprises a rotated heat roller 21*a* and a pressure roller 21*b* brought into pressure contact therewith and giving heat and pressure to the transferring material S. That is, the transferring material S to which the toner images on the photosensitive drums 1 have been transferred is conveyed by the pair of fixing rollers 21 (21*a* and 21*b*) when it passes through the fixing portions 20, and also is given heat and pressure by the pair of fixing rollers 21. Thereby, the toner images of the plural colors are fixed on the surface of the transferring materials S.

As the image forming operation, the process cartridges 7 are successively driven in accordance with the print timing, and in conformity with the driving thereof, the photosensitive drums 1 are counter-clockwisely rotatively driven. Then the scanner units 3 corresponding to the respective process cartridges 7 are successively driven. By this driving, the electrifying rollers 2 impact uniform charges to the peripheral surfaces of the photosensitive drums 1, and the scanner units 3 effect exposure on the peripheral surfaces of the photosensitive drums 1 in conformity with the image signal to thereby form electrostatic latent images on the peripheral surfaces of the photosensitive drums 1. The developing rollers 40 in the developing apparatuses 4 cause the toners to shift to the low potential portions of the electrostatic latent images, thereby forming (developing) toner images on the peripheral surfaces of the photosensitive drums 1.

At the timing whereat the leading edge of the toner image on the peripheral surface of the most upstream photosensitive drum 1 (the photosensitive drum 1*a* in FIG. 1) is rotatively conveyed to the opposed point to the electrostatic transferring belt 11, the pair of registration rollers 19 start their rotation and feed the transferring material S to the electrostatic transferring belt 11 so that the print starting position of the transferring material S may coincide with the opposed point.

The transferring material S is designed such that it is brought into pressure contact with the outer periphery of the electrostatic transferring belt 11 in such a manner as to be sandwiched by and between an electrostatic adsorbing roller 22 and the electrostatic transferring belt 11 and a voltage is applied between the electrostatic transferring belt 11 and the electrostatic adsorbing roller 22 to thereby induce charges in the dielectric material layers of the transferring material S and the electrostatic transferring belt 11 which are dielectric materials, and electrostatically adsorb the transferring material to the outer periphery of the electrostatic transferring belt 11. Thereby, the transferring material S is stably adsorbed to the electrostatic transferring belt 11 and is conveyed to the most downstream transferring portion. The transferring material S, while being thus conveyed, has the toner images on the photosensitive drums 1 successively transferred thereto by an electric field formed between each photosensitive drum 1 and each transferring roller 12.

The transferring material S to which the toner images of the four colors have been transferred is curvature-separated from the electrostatic transferring belt 11 by the curvature of the belt driving roller 13 and is conveyed to the fixing portion 20. The transferring material S has the toner images thereon heat-fixed by the fixing portion 20, whereafter it is discharged out of the apparatus from a discharging portion 24 by a pair of discharging rollers 23 with its image bearing surface facing downwardly.

Process Cartridges

The process cartridges into which the present invention has been embodied will now be described with reference to FIGS. 2 and 3. The process cartridges 7 (7*a*, 7*b*, 7*c* and 7*d*) for yellow, magenta, cyan and black are the same in construction.

Each of the process cartridges 7 is divided into a drum-shaped electrophotographic photosensitive member, i.e., a photosensitive drum 1, which is an image bearing member, a drum unit 50 provided with electrifying means and cleaning means, and a developing apparatus (developing unit) 4 as developing means for developing an electrostatic latent image on the photosensitive drum 1.

As shown in FIG. 11, the drum unit 50 is such that the photosensitive drum 1 is rotatably mounted on a cleaning frame 51 through bearings 31*a* and 31*b*. On the periphery of the photosensitive drum 1, there is disposed an electrifying device 2 as primary electrifying means for uniformly electrifying the surface of the photosensitive drum 1, and a cleaning blade 60 is disposed in a cleaning apparatus 6 for removing any toner residual on the photosensitive drum 1, and further the residual toner removed from the surface of the photosensitive drum 1 by the cleaning blade 60 is sent into a waste toner chamber 53 provided rearwardly of the cleaning frame by a toner carrying mechanism 52. The driving force of a driving motor, not shown, is transmitted to one rear end as viewed in FIG. 2, whereby the photosensitive drum 1 may be counter-clockwisely rotatively driven in conformity with the image forming operation.

The developing unit 4 is comprised of a developing roller 40 being in contact with the photosensitive drum 1 and rotated in the direction of arrow Y, a toner container 41 in which the toner is contained, and a developing frame 45. The developing roller 40 is rotatably supported by the developing frame 45 through holding members (developing holders) 47 and 48, and there are disposed a toner supplying roller 43 contacting with the developing roller 40 in the circumferential direction of the latter and rotated in the direction of arrow Z, a developing blade 44 and a toner electrifying roller 54 as developer electrifying means contacting with the developing roller 40 and driven to rotate thereby. Further, in the toner container 41, there is provided a toner carrying mechanism 42 for agitating the contained toner and also carrying the toner to the toner supplying roller 43.

The developing unit 4, as shown in FIG. 3, is of suspended structure in which the entire developing unit 4 is supported by a pin 49*a* for pivotal movement relative to the photosensitive drum unit 50 about a support shaft 49 provided on the holding members 47 and 48 attached to the opposite ends of the developing unit 4, and in the single piece state (not mounted on the main body of the image forming apparatus) of the process cartridge 7, the developing unit 4 is always pressed by a pressurizing spring 70 so that the developing roller 40 may contact with the photosensitive drum 1 by a rotational moment about the support shaft 49. Further, the toner container 41 of the developing unit 4 is integrally provided with a rib 46 for the spacing means of the main body of the image forming apparatus A to abut there against when the developing roller 40 is to be spaced apart from the photosensitive drum 1.

During development, when the contained toner is carried to the toner supplying roller 43 by the toner carrying mechanism 42, the toner supplying roller 43 being rotated in the direction of arrow Y supplies the toner to the developing roller 40 by the frictional contact thereof with the developing roller being rotated in the direction of arrow Z, as shown in FIG. 2, and causes the toner to be carried on the developing roller 40. The toner carried on the developing roller 40 comes to the developing blade 44 with the rotation of the developing roller 40, and the developing blade 44 imparts charges to the toner and also forms the toner into a predetermined thin toner layer.

The toner comes to the toner electrifying roller 54 with the further rotation of the developing roller 40. The toner electrifying roller 54 is being driven to rotate by the developing roller 40, and effects the imparting of charges for further uniformizing the amount of electrification charges of the toner imparted by the developing blade 44 (the details of this will be described later). The toner is then carried to a developing portion in which the photosensitive drum 1 and the developing roller 40 are in contact with each other, and by a DC developing bias applied from a voltage source, not shown, to the developing roller 40, the toner adheres to the electrostatic latent image formed on the surface of the photosensitive drum 1, whereby a toner image is formed.

Any toner residual on the surface of the developing roller 40 without contributing to development is returned into the developing unit 4 with the rotation of the developing roller 40, and is stripped off and collected from the developing roller 40 by the frictional contact portion thereof with the toner supplying roller 43. The collected toner is agitated and mixed with the remaining toner by the toner carrying mechanism 42.

In the contact developing system wherein as in the present embodiment, development is effected with the photosensitive drum 1 and the developing roller 40 being in contact with each other, it is preferable that the photosensitive drum 1 be a rigid member and the developing roller 40 used therewith be a roller having an elastic member. As this elastic member, use is made of a solid rubber single layer, or with the electrifying property for the toner taken into account, a solid rubber layer provided with a resin coating thereon.

Positioning of the Process Cartridge

Figure 13:
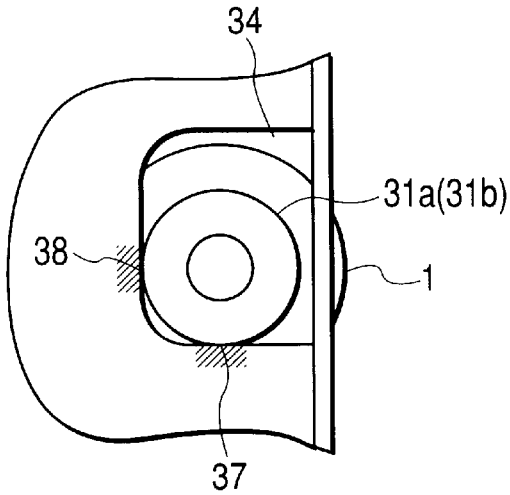
FIG. 13 illustrates the method of positioning the process cartridge in the image forming apparatus.

The mounting of the process cartridge 7 onto the main body A of the apparatus, as shown in FIG. 11, is effected by inserting the bearings 31*a* and 31*b* supporting the photosensitive drum 1 along a first guide groove 34 on the direction of arrow. Then, as shown in FIG. 13, the bearings 31*a* and 31*b* are urged against the bumping surfaces 37 and 38 of the guide groove 34, whereby the position of the process cartridge 7 is determined. Regarding a method of pressing the process cartridge 7 in the main body of the printer, as shown in FIG. 12, a shaft 39 is caulked on left and right side plates 32, and a torsion coil spring 30 is supported on the shaft 39 and the end portion 30*a* thereof is fitted in and fixed to the holes 32*a* of the left and right side plates. In a state in which the process cartridge 7 is absent, the torsion coil spring 30 is regulated in the direction of rotation by a bent-up portion 32*b* from the left and right side plates. When the process cartridge 7 is inserted, the torsion coil spring 30 is counter-clockwisely rotated while resisting its own force, and when it clears the bearings 31*a* and 31*b*, it is positioned as shown in FIG. 12 and presses with a force of about 9.8N in the direction of the arrow F.

Toner Electrifying Roller

The construction of the toner electrifying roller 54 of the developing unit 4 in the present embodiment will now be described in detail with reference to FIGS. 4, 5, 6, 7 and 8.

As shown in FIG. 4, the developing roller 40 of the developing unit 4 is rotatably supported on the developing frame 45 through holding members 47 and 48. Also, the toner electrifying roller 54 is likewise held by the holding members 47 and 48.

As shown in FIG. 5, the toner electrifying roller 54 is an electrically conductive roller formed into a roller shape by a metallic mandrel and an electrically conductive material, and this roller is brought into contact with the developing roller 40 and is driven to rotate by the developing roller 40, and a bias voltage is applied thereto to thereby uniformly impart charges to the toner thin-layer-regulated on the surface of the developing roller 40 which differs in the eleclification charge amount depending on environment such as temperature and humidity. The opposite end portions of the mandrel of the toner electrifying roller 54 are rotatably supported by bearing members 55. As the bearing members 55, use is made of substantially cylindrical sliding bearings or anti-friction bearings formed of a sliding resin material.

As shown in FIG. 6, the holding member 47 is provided with a developing roller bearing portion 47*a,* a toner supplying roller bearing portion 47*b* and a toner electrifying roller bearing portion 47*c*. The toner electrifying roller bearing portion 47*c* is a U-shaped guide groove in a direction linking the center of the toner electrifying roller 54 and the center of the developing roller 40 together. The toner electrifying roller 54 is incorporated into the toner electrifying roller bearing portion 47*c* in such a manner as to assemble the bearing members 55 to the opposite end portions thereof, and thereafter adjust the bearing members 55 to the guide groove.

As shown in FIG. 7, a toner electrifying roller pressurizing spring 56 such as a torsion coil spring is used as pressurizing means (biasing means) for pressurizing the toner electrifying roller 54 against the developing roller 40. The toner electrifying roller pressurizing spring 56 is first attached to a boss 47*d* provided on the holding member 47, whereafter one end 56*a* of the toner electrifying roller pressurizing spring 56 is hooked onto a stopper 47*e* and the other end 56*b* of the pressurizing spring 56 is hooked onto the bearing member 55 of the toner electrifying roller 54. Thereby, the toner electrifying roller 54 becomes pressurized against the developing roller 40. When such a pressurizing construction is adopted, such an inconvenience as bad rotation does not occur because the bearing members 55 are used and the resistance to pressurization is mitigated.

Also, as shown in FIG. 8, each of the bearing members 55 of the toner electrifying roller is provided with ribs 55*a* and 55*b* as projected portions on the opposite end portions of the cylindrical surface thereof in the axial direction of the toner electrifying roller. The other end 56*b* of the pressurizing spring 56 is hooked onto the area sandwiched between these two ribs, whereby the movement of the pressurizing spring 56 in the axial direction of the toner electrifying roller is regulated, and it is made possible to prevent the pressurizing spring from axially deviating and coming off.

By constructing so, the toner electrifying roller 54 slides with the bearing members 55 and receives pressure through the bearing members 55 and therefore, the rotational resistance thereof is mitigated and the stable rotation thereof becomes possible. Also, the bearing members 55 are provided with the ribs 55*a* and 55*b* for preventing the coming-off of the pressurizing spring 56, whereby it becomes difficult for the pressurizing spring 56 from coming off even when it is vibrated during transportation or during handling. Accordingly, a stable pressure force is brought about to the toner electrifying roller 54 and stable rotation is brought about to the developing roller 40, and uniform charges can be imparted to the toner on the developing roller 40.

Figure 20:
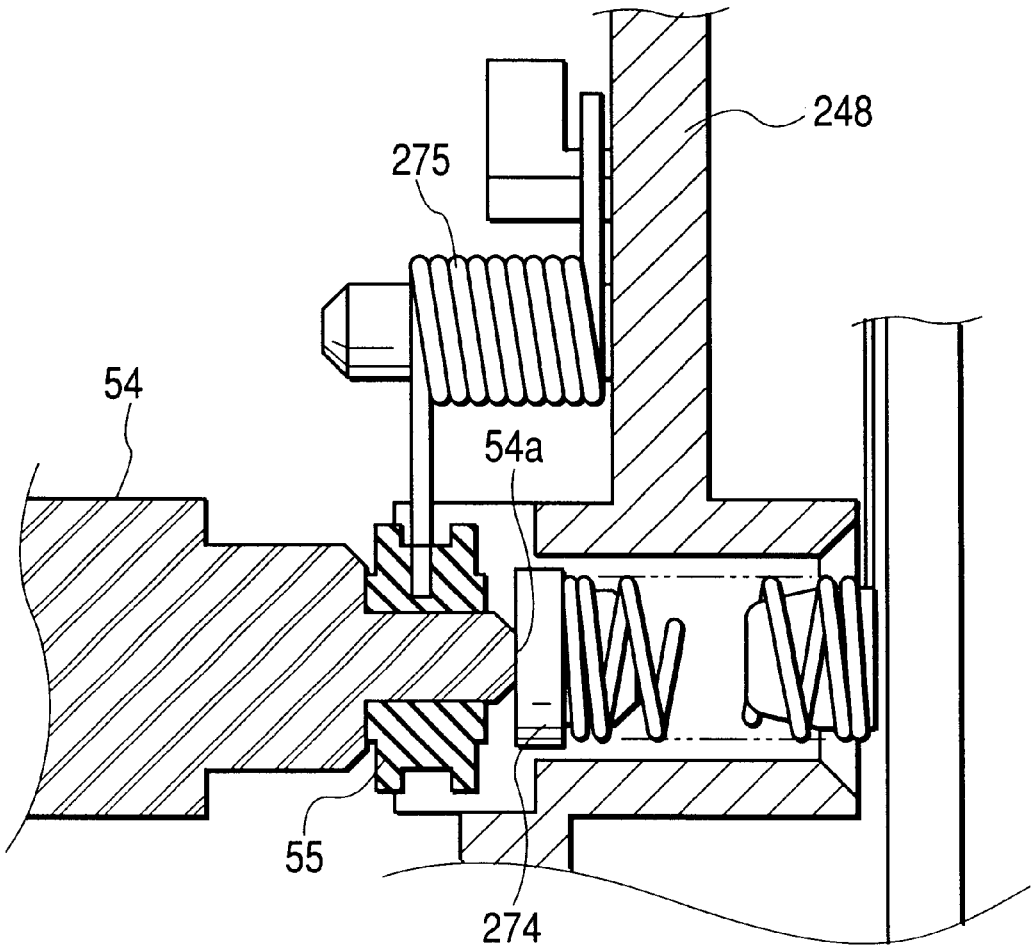
FIG. 20 is a cross-sectional view of the essential portions of the developing apparatus.

In the above-described embodiment, the supply of electric power to the toner electrifying roller 54 is effected with a contact member (electrode member) 274 abutting against the end surface 54*a* of the toner electrifying roller 54, as shown in FIG. 20. Also, the toner electrifying roller 54 is adapted to be incorporated into the developing apparatus with the bearing members 55 for rotatably supporting the toner electrifying roller 54 being tentatively assembled as shown in FIG. 5 after the developing blade 44, the developing roller 40, etc. have been incorporated into the developing container 48.

In the construction of FIG. 20, however, the toner electrifying roller 54 with the bearing members 55 tentatively assembled thereto is moved during assembly and therefore, the bearing members 55 have sometimes come off before assembly is completed.

Or due to the vibrations and shocks during transportation or when the user has dropped the developing apparatus by mistake, the positional relationship between the contact member 274 for effecting the supply of electric power to the toner electrifying roller 54 and the toner electrifying roller 54 has sometimes been spoiled.

In order to solve such problems, according to the following embodiment, there is provided a construction which makes the stable application of a voltage from the main body of the developing apparatus to the developer electrifying member possible, and there is also provided a construction in which the electrification charge amount of the toner on the developer carrying member is stably obtained even under various environments and which is easy to assemble and in which the portion for supplying electric power to the developer electrifying member can sufficiently stand the vibrations and shocks during transportation.

Another Embodiment

Another embodiment of the developing apparatus will be described below.

The construction of main body of the image forming apparatus, the construction of the process cartridge except for the developing apparatus, and the basic construction of the developing apparatus are as previously described and therefore need not be described. The toner electrifying roller, the bearing members, the holding members and the pressurizing member differ a little from those in the above-described embodiment.

Developing Apparatus

The constructions of the developing roller and toner electrifying roller of the developing apparatus and a method of mounting them will hereinafter be described with reference to FIGS. 10, 14A, 14B, 15, 16, 17, 18 and 19.

Figure 10:
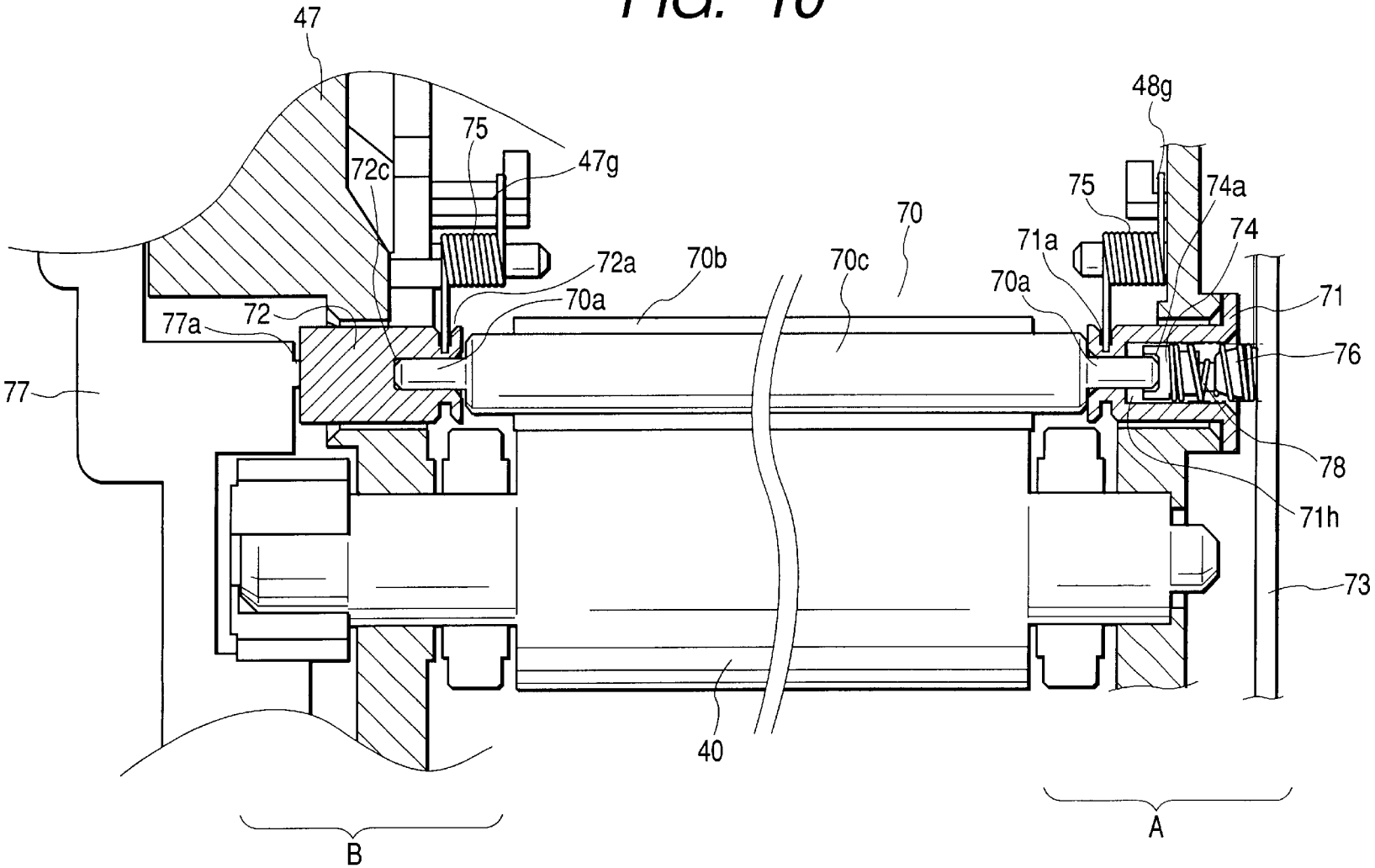
FIG. 10 is a cross-sectional view of the essential portions of a developing apparatus according to a second embodiment.

As shown in FIG. 10, the toner electrifying roller 70 is an electrically conductive roller formed by a metallic mandrel 70*c* and an elastic portion 70*b* formed of an electrically conductive material, and this roller is brought into contact with the developing roller 40 and is driven to rotate thereby, and a bias voltage is applied thereto to thereby uniformly impart charges to the thin-layer-regulated toner on the surface of the developing roller 40 which differs in the electrification charge amount depending on environment such as temperature and humidity. The opposite end portions 70*a* of the mandrel of the toner electrifying roller 70 are rotatably supported by bearing members 71 and 72. In the present embodiment, resin bearings formed of a sliding resin material (such as POM) are used as the resin members 71 and 72.

Figure 14A:
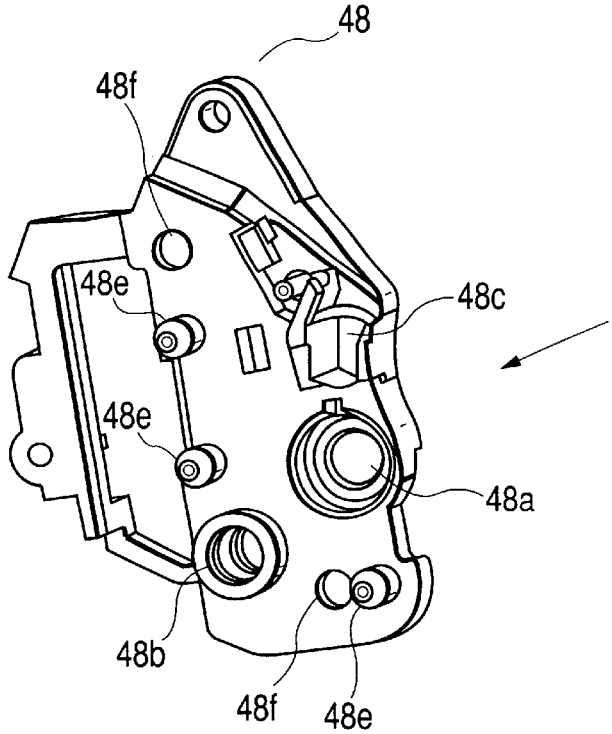
FIGS. 14A and 14B illustrate the construction of a holding member.
Figure 14B:
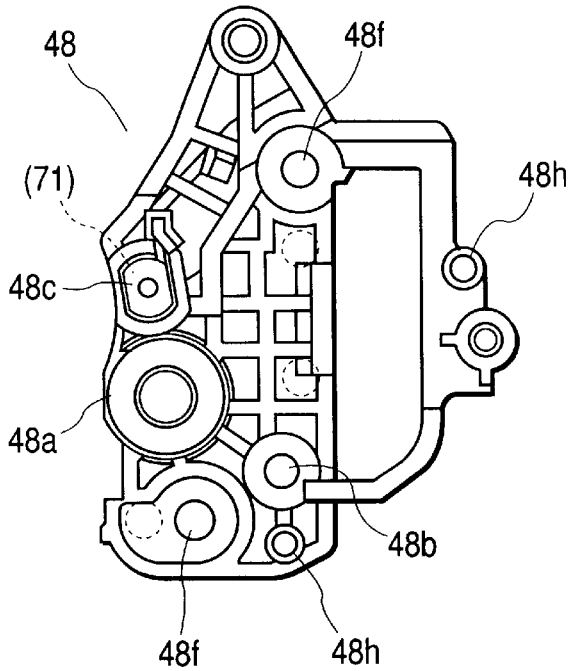

On the other hand, as shown in FIGS. 14A and 14B, the holding member 48 is provided with a developing roller bearing portion 48*a,* a toner supplying roller bearing portion 48*b* and a cavity portion 48*c* provided so as to cover the bearing member 71. The cavity portion 48*c,* as shown in FIG. 14B, is of a slot shape, and has a gap in which the bearing member is movable relative to the direction of a live linking the center of the developing roller 40 and the center of the rotary shaft of the toner electrifying roller 70 together, and is in fitted relationship with the bearing member 71 in a direction orthogonal to the aforementioned direction. The holding member 47 is also similar in construction.

The attachment of the developing roller 40, the holding members 47, 48, the toner electrifying roller 70 and the bearing members 71 and 72 to the developing container (developing frame) is effected by the following procedure.

Figure 15:
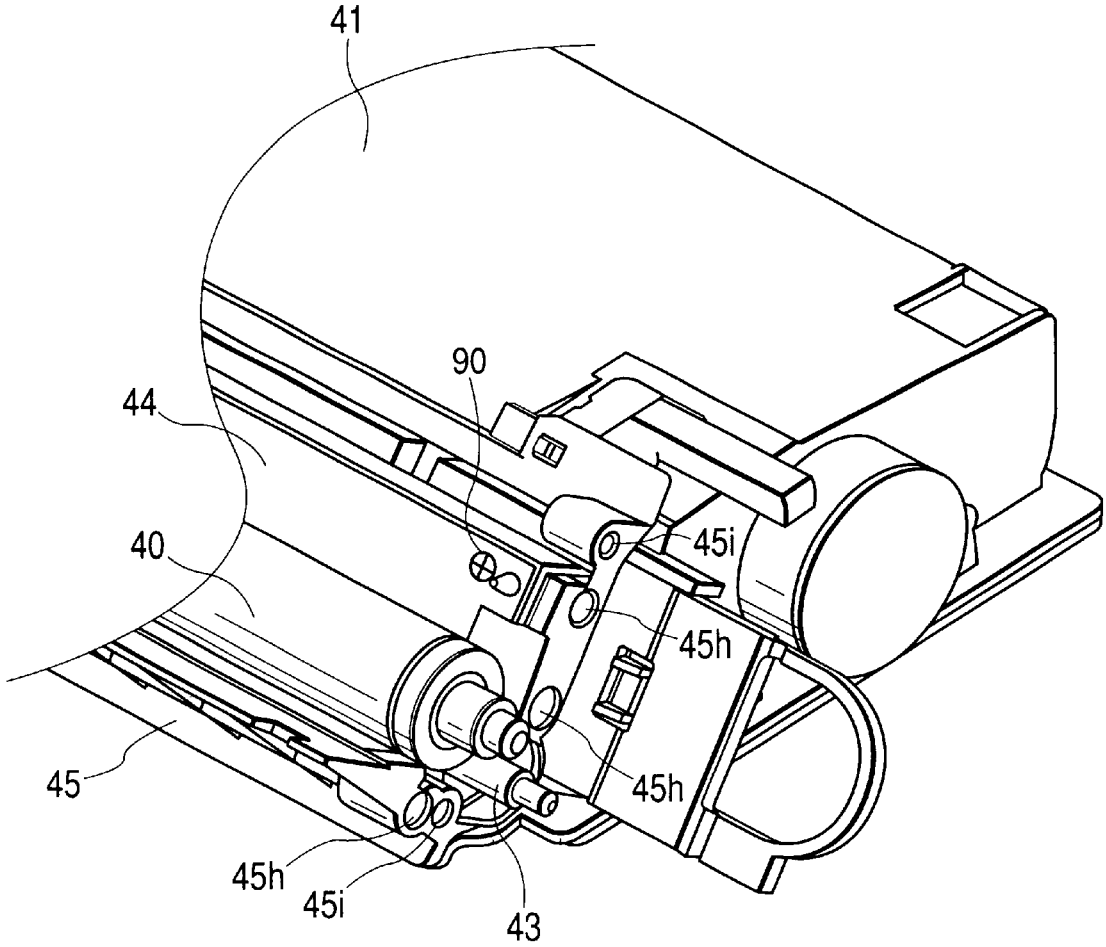
FIG. 15 is a perspective view illustrating a method of assembling a developing unit.

As shown in FIG. 15, the toner container 41 is attached to the developing frame 45 by such means as bead welding. Moreover, the toner supplying roller 43 and a seal member (not shown) for preventing the toner from leaking out of the developing frame 45 are attached to the developing frame 45. Further, the developing blade 44 is fixed to the developing frame 45 by a screw 90.

One lengthwise side of the developing frame 45 is formed with an aperture 45*h* for effecting the positioning thereof with respect to the holding member 48 and a lower aperture 45*i* for screwing the holding member. On the other hand, as shown in FIGS. 14A and 14B, the holding member 48 has positioning bosses 48*e* and an aperture 48*f* for passing a screw therethrough formed at locations corresponding to apertures 45*h* formed in a side of the developing frame 45. The other lengthwise side of the developing frame 45 (the side to which the holding member 47 is attached) is similar in construction to the holding member 48.

As shown in FIG. 15, the developing roller 40 is placed on the developing frame 45 to which up to the developing blade 44 is attached, and the holding members 47 and 48 are disposed along the apertures 45*h* from the opposite sides of the developing frame 45, and the developing roller 40 and the toner supplying roller 43 are combined so as to coincide with the bearing portions 47*a,* 47*b* and 48*a,* 48*b* of the holding members 47 and 48, respectively, and the holding members 47 and 48 are fixed to the developing container 45 by screws.

Figure 16:
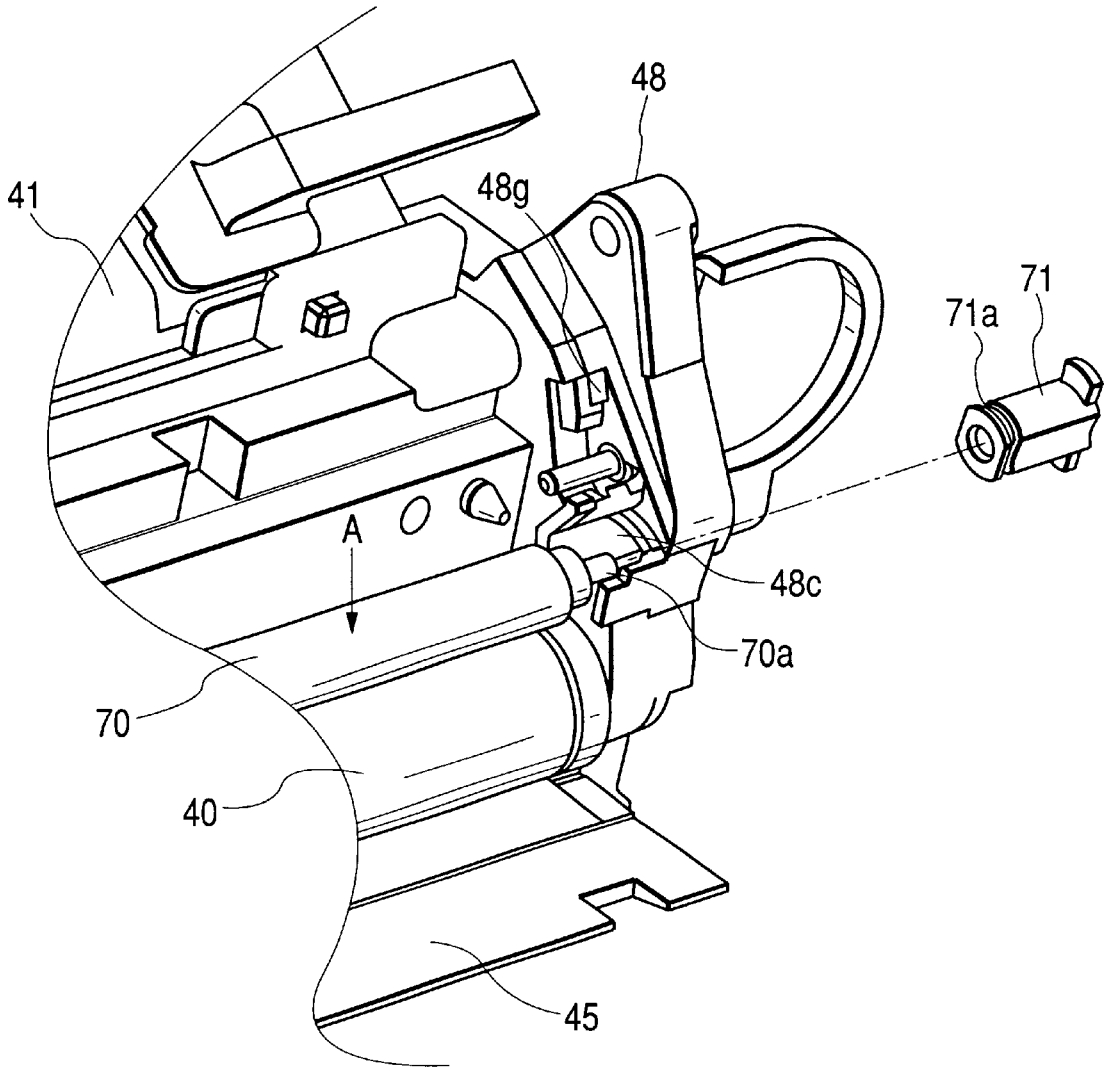
FIG. 16 is a perspective view illustrating the method of assembling the developing unit.

Thereafter, as shown in FIG. 16, the toner electrifying roller 70 is tentatively placed into the cavity portion 48*c* of the holding member from the direction of arrow A. At this time, such parts as the bearing members are not held on the toner electrifying roller 70 in their tentatively assembled state and therefore, the coming-off or the like of the parts need not be taken into account, and the handling is easy and this is excellent in the assembly property.

Also, in ordinary assembly, the elastic portion 70*b* of the toner electrifying roller 70 is adapted not to be touched by the user's hand with the influence upon the image taken into account, and for the transportation of the toner electrifying roller 70, the end portion 70*a* of the mandrel is adapted to be held by the user's hand. In the present construction, as previously described, no other parts are assembled to the toner electrifying roller 70 and therefore, the end portion 70*a* of the mandrel is all exposed, and the area usable for transportation is wide and in this respect as well, the handling of the parts becomes easy.

Next, the bearing member 71 is passed through the cavity portion 48*c* of the holding member 48 from the direction of the rotary shaft of the toner electrifying roller 70, and is further incorporated so as to fit to the end portion 70*a* of the mandrel of the toner electrifying roller 70. Thus, the toner electrifying roller 70 has been rotatably incorporated relative to the developing frame 45 (see FIG. 10).

Further, as shown in FIG. 10, pressurizing members (biasing members) 75 for pressing the toner electrifying roller 70 against the developing roller are attached to the holding members 47 and 48. After the toner electrifying roller 70 and the bearing members 71, 72 are assembled to the holding members 47 and 48, one end of the pressurizing members 75 is incorporated into the portions 47*g* and 48*g* of the holding members 47 and 48 to which the pressurizing members are attached, and the other ends thereof are incorporated into concave grooves (the portions to which the pressurizing members are attached) 71*a* and 72*a* provided in the bearing members 71 and 72, respectively. Thereby, the toner electrifying roller 70 is pressed against the developing roller 40 to become capable of being reliably driven to rotate, and further the concave grooves 71*a* and 72*a* regulate so that the pressurizing members 75 move toward the rotational axis of the toner electrifying roller 70.

Figure 17:
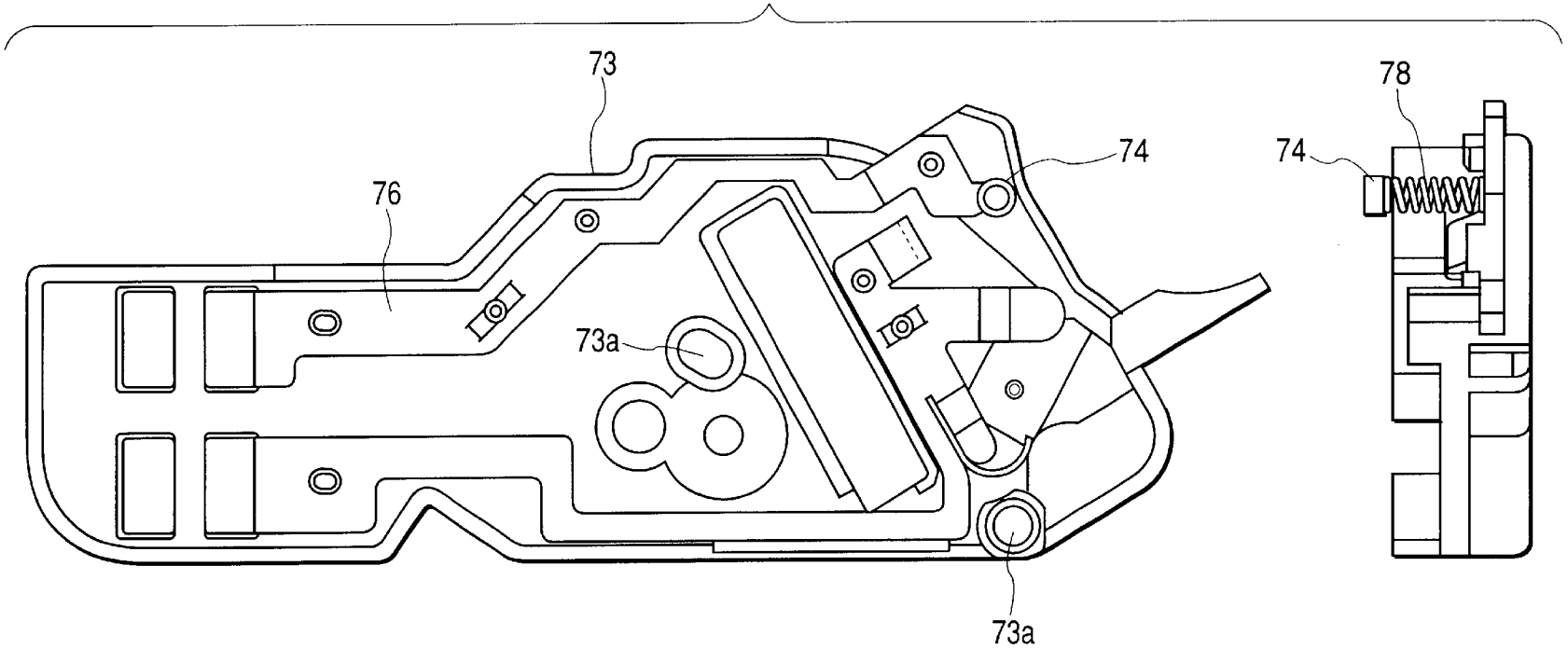
FIG. 17 illustrates the construction of a side cover.
Figure 18:
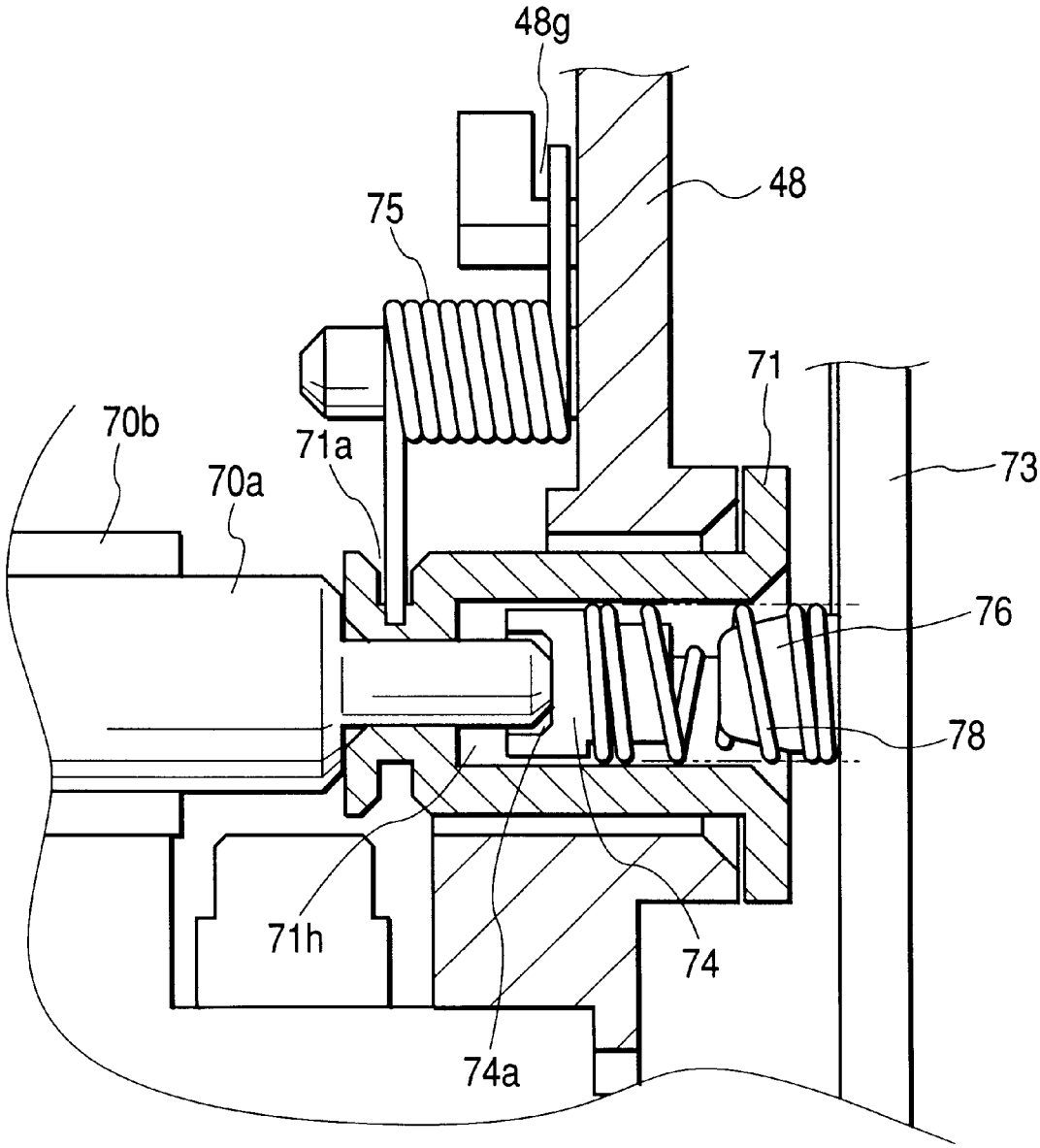
FIG. 18 is an enlarged cross-sectional view of the essential portions of the developing apparatus.

The construction of the portion A (the developing unit non-driving side) of FIG. 10 will be shown below. (FIG. 18 is an enlarged view of the portion A of FIG. 10.) As shown in FIG. 10, a side cover 73 is provided on the outer side of the holding member 48. The side cover 73, as shown in FIG. 17, has incorporated in advance therein a contact member (electrode member) 74, a contact spring 78 and a contact plate 76 which are electric power supplying means to the toner electrifying roller 70. The contact plate 76 is a portion of an electric power supplying path for applying a bias voltage from the main body of the image forming apparatus to the developing apparatus, and is adapted to become capable of supplying electric power when the developing apparatus is incorporated into the image forming apparatus (not shown).

On the other hand, as shown in FIG. 18, the bearing member 71 is formed with a hole 71*h* so as to receive the contact member 74 therein and so that the contact member 74 and the end portion 70*a* of the mandrel of the toner electrifying roller may contact with each other to thereby bring about an electrically conducting state.

Further, a recess 74*a* is provided in the end surface of the contact member 74, and is adapted to cover the end portion 70*a* of the mandrel of the toner electrifying roller 70 when the contact member 74 is incorporated. Also, the fixing of the contact member 74 and the contact plate 76 to the contact spring 78 is accomplished by light press fitting.

The assemblage of the side cover 73 to the developing unit and the supply of electric power to the toner electrifying roller 70 are effected by the following procedure.

As shown in FIG. 14B, the holding member 48 is provided with positioning bosses 48*h* for the side cover 73. On the other hand, as shown in FIG. 17, the side cover 73 is provided with positioning holes 73*a* at locations corresponding to the bosses 48*h* of the holding member 48.

After the bearing member 71 is assembled to the holding member 48, the side cover 73 is combined with the holding member 48 while the positioning holes 73*a* formed in the side cover 73 and the positioning bosses 48*h* of the holding member 48 are aligned with each other. At this time, the contact member 74 is combined so as to enter the hole 71*h* of the bearing member 71. The side cover 73 is then assembled until it is brought into close contact with the holding member, whereafter it is fixed by a screw (not shown). Thus, the contact plate 76, the contact spring 78, the contact member 74 and the end portion 70*a* of the mandrel of the toner electrifying roller come into contact with one another, and the electric power supplying path from the main body of the image forming apparatus to the toner electrifying roller 70 is completed.

The construction of the portion B (the developing unit driving side) of FIG. 10 will be shown below.

Figure 19:
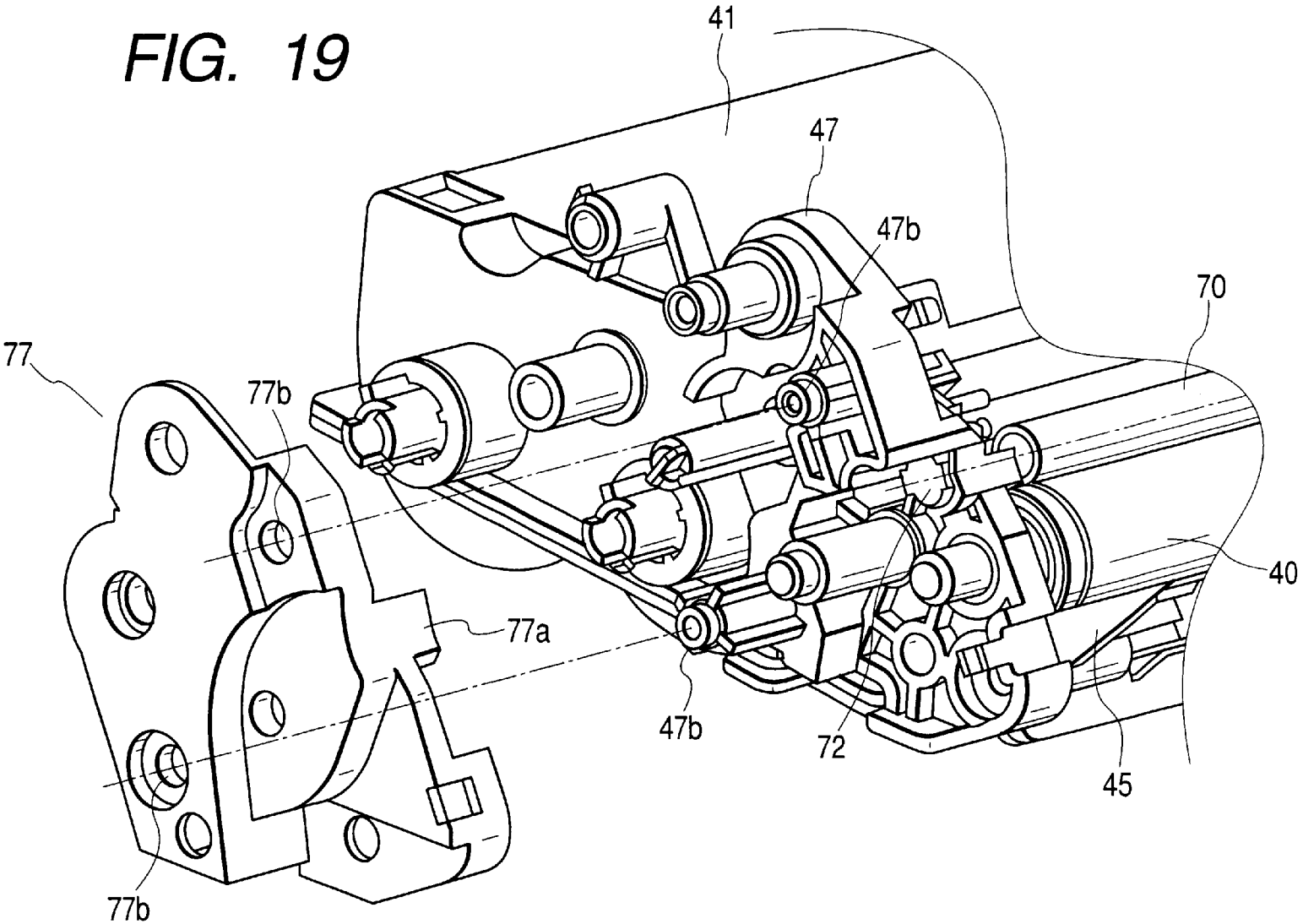
FIG. 19 illustrates a method of assembling the driving side of the developing apparatus.

(FIG. 19 is a perspective view of the portion B of FIG. 10).

A method of assembling the holding member 47 and the bearing member 72 is similar to the assemblage of the aforedescribed developing unit non-driving side.

As shown in FIG. 19, a driving side side cover 77 is provided on the outer side of the holding member 47. The driving side side cover 77 is provided with an axial regulating portion 77*a* for regulating the axial movement of the toner electrifying roller relative to the bearing member 72.

For the attachment of the driving side side cover 77, the holding member 47, the toner electrifying roller 70 and the bearing member 72 are assembled, whereafter a gear (not shown) for driving the developing unit is mounted on the holding member 47, and the positioning boss 47*b* of the holding member 47 is aligned with the positioning hole 77*b* of the driving side side cover 77 and is fixed to the holding member 47 by a screw. Thereby, the bearing member 72 has its amount of axial movement regulated by the regulating portion 77*a* of the driving side side cover 77. Also, the bearing member 72, as shown in FIG. 10, is provided with an end surface 72*c* for effecting the lengthwise regulation of the toner electrifying roller 70.

By the contact spring 78 provided on the non-driving side, the toner electrifying roller 70 is biased toward the driving side in the lengthwise direction thereof. On the driving side, there are provided the aforedescribed regulating portion 77*a* of the driving side side cover 77 and the end surface 72*c* of the bearing member 72, and the toner electrifying roller 70 is defined at a predetermined position. The contact spring 78 is designed to hold a sufficient pressure force against the toner electrifying roller 70 at this time, and sufficient contact pressure is adapted to be secured between the toner electrifying roller 70 and the contact member 74. By such construction, the toner electrifying roller 70 is always held at the predetermined position in the lengthwise direction thereof and at the same time, the supply of electric power to the toner electrifying roller 70 is effected stably.

Also, the contact member 74 is designed to cover the end portion 70*a* of the mandrel of the toner electrifying roller and therefore, even if there occurs such a situation that due to the vibrations or shocks during transportation, the toner electrifying roller 70 instantaneously floats up from the developing roller 40, the positional relationship between the contact member 74 and the electrifying roller 70 can be prevented from deviating. Further, instead of the contact member 74 covering the end portion 70*a* of the mandrel, the end surface of the toner electrifying roller may have a recess and the contact member 74 may be provided so as to come into this recess.

As in the present embodiment, the bearing member is designed to be covered with the holding member by a predetermined amount whereby it becomes unnecessary to incorporate the bearing member into the developing unit with the bearing member tentatively assembled to the toner electrifying roller, and the assembly become easy and at the same time, the toner electrifying roller and the contact member are designed to overlap each other in the lengthwise direction by a predetermined amount, whereby the supply of electric power to the toner electrifying roller is effected reliably and the electrification charge amount on the developing roller becomes constant irrespective of environmental conditions and also, the positional relationship between the toner electrifying roller and the contact member can be prevented from being deviated due to vibrations or shocks to thereby cause bad contact.

Other Embodiments

While in the aforedescribed embodiments, as the process cartridge, the photosensitive drum 1 and the developing unit 4 and the drum unit 50 as the process means acting on the photosensitive drum 1 are integrally constructed, this is not restrictive, but if for example, the process cartridge has the photosensitive drum 1 and at least the developing unit 4, it need not be made to have other process means. Accordingly, as a form of the process cartridge, for example, the photosensitive drum and the developing unit may be integrally made into a cartridge which is detachably attachable to the main body of the apparatus. Also, the process cartridge having, for example, the photosensitive drum 1 and at least the developing unit 4 may have one or more other process means. For example, the photosensitive drum, the developing unit and the electrifying means may be integrally made into a cartridge which is detachably attachable to the main body of the apparatus, or for example, the photosensitive drum, the developing unit and the cleaning means may be integrally made into a cartridge which is detachably attachable to the main body of the apparatus, or further the photosensitive drum, the developing unit and a combination of two or more of the aforementioned process means may be integrally made into a cartridge which is detachably attachable to the main body of the apparatus.

Also, while in the aforedescribed embodiments, the developing unit 4 having the developing roller 40, the toner supplying roller 43 and the toner electrifying roller 54 is constructed and this is integrally constructed in a process cartridge, this is not restrictive, but instead of making it into a process cartridge, it is also possible to carry it out as a developing apparatus 4 provided in the image forming apparatus. Also, the developing apparatus alone can be applied to a developing cartridge or the like which is made detachably attachable to the main body of the image forming apparatus.

What is claimed is:

1. A developing apparatus comprising:

a developer carrying member for carrying a developer thereon, and developing an electrostatic image formed on an image bearing member with the developer;

a rotatable developer electrifying member for contacting with the developer carried on said developer carrying member, and electrifying the developer carried on said developer carrying member;

a holding member for holding said developer electrifying member and said developer carrying member; and a bearing member assembled to said holding member for receiving a shaft of said developer electrifying member, said developer electrifying member being held by said holding member by means of said bearing member.

2. A developing apparatus according to claim 1, wherein said bearing member is substantially cylindrical.

3. A developing apparatus according to claim 1, wherein a voltage is applied to said developer electrifying member.

4. A developing apparatus according to claim 1, further comprising a biasing member for biasing said bearing member so that said developer electrifying member is pressed against said developer carrying member.

5. A developing apparatus according to claim 1, wherein said holding member includes a guide portion for guiding said developer electrifying member in a direction in which said developer electrifying member approaches said developer carrying member.

6. A developing apparatus according to claim 5, wherein said guide portion is a U-shaped groove formed in said holding member.

7. A developing apparatus according to claim 4, wherein said bearing member includes a regulating portion for regulating a movement of said biasing member toward said shaft.

8. A developing apparatus according to claim 7, wherein an end portion of said biasing member is attached to said holding member.

9. A developing apparatus according to claim 7, wherein said regulating portion is one of being projection-shaped and concave-shaped.

10. A developing apparatus according to claim 4, 7 or 8, wherein said biasing member includes a torsion coil spring.

11. A developing apparatus according to claim 1, wherein said bearing member includes a portion covered by said holding member in an axial direction of said shaft.

12. A developing apparatus according to claim 11, further comprising an electrode member for applying a voltage to said developer electrifying member, said electrode member being covered by said bearing member.

13. A developing apparatus according to claim 12, wherein said electrode member applies the voltage to an end surface of said shaft.

14. A developing apparatus according to claim 13, wherein said electrode member includes a recess formed therein, and said end portion of said shaft is covered by said recess.

15. A developing apparatus according to claim 1, wherein said developer electrifying member is roller-shaped.

16. A developing apparatus according to claim 15, wherein said developer electrifying member is rotatably driven by said developer carrying member.

17. A developing apparatus according to claim 1, further comprising a developing frame containing the developer therein, and wherein said holding member is attached to an end portion of said developing frame in an axial direction of said shaft.

18. A developing apparatus according to claim 1, which is detachably provided in a main body of an image forming apparatus.

19. A developing apparatus according to claim 18, wherein said image bearing member is provided in a process cartridge detachably attachable to the main body of the image forming apparatus.

* * * * *

UNITED STATES PATENT AND TRADEMARK OFFICE

CERTIFICATE OF CORRECTION

PATENT NO. : 6,654,583 B2
DATED : November 25, 2003
INVENTOR(S) : Tatsuya Suzuki et al.

It is certified that error appears in the above-identified patent and that said Letters Patent is hereby corrected as shown below:

Column 1,
Line 66, “As an” should read -- An --.

Column 2,
Line 19, “when re and” should read -- when read --.

Column 3,
Line 15, “a” should read -- as --;
Line 18, “counter-clockwisely” should read -- counter-clockwise --;
Line 51, “counter-” should read -- is rotatively driven counter-clockwise. --; and
Line 52, “clockwisely rotatively driven” should be deleted.

Column 4,
Lines 21 and 22, “clockwisely rotated” should read -- rotated clockwise --.

Column 6,
Line 36, “counter-clockwisely rotatively driven” should read -- rotatively driven counter-clockwise --.

Column 10,
Line 18, “live” should read -- line --; and
Line 47, “up to” should be deleted.

Column 11,
Line 34, “As shown” should read -- ¶As shown --.

UNITED STATES PATENT AND TRADEMARK OFFICE

CERTIFICATE OF CORRECTION

PATENT NO. : 6,654,583 B2
DATED : November 25, 2003
INVENTOR(S) : Tatsuya Suzuki et al.

It is certified that error appears in the above-identified patent and that said Letters Patent is hereby corrected as shown below:

Column 13,
Line 6, “become” should read -- becomes --.

Signed and Sealed this

Sixteenth Day of March, 2004

JON W. DUDAS
*Acting Director of the United States Patent and Trademark Office*